US008657402B2

(12) United States Patent
Maeyama et al.

(10) Patent No.: US 8,657,402 B2
(45) Date of Patent: Feb. 25, 2014

(54) IMAGE FORMING APPARATUS INCLUDING SHEET CUTTING DEVICE

(75) Inventors: Yuichiro Maeyama, Kanagawa (JP); Masahiko Yamada, Tokyo (JP); Masato Ogawa, Kanagawa (JP); Kazuhiro Wakamatsu, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 13/307,157

(22) Filed: Nov. 30, 2011

(65) Prior Publication Data

US 2012/0139987 A1 Jun. 7, 2012

(30) Foreign Application Priority Data

Dec. 2, 2010 (JP) ..... 2010-269389

(51) Int. Cl.
*B41J 29/38* (2006.01)

(52) U.S. Cl.
USPC ..... 347/16; 347/104

(58) Field of Classification Search
USPC ..... 347/16, 20, 101, 102, 104
See application file for complete search history.

(56) References Cited

U.S. PATENT DOCUMENTS

| | | | | |
|---|---|---|---|---|
| 5,614,928 | A * | 3/1997 | Matsuda | 347/2 |
| 5,805,193 | A * | 9/1998 | Follett et al. | 347/171 |
| 2011/0064497 | A1 | 3/2011 | Niihara et al. | |
| 2011/0211210 | A1 | 9/2011 | Niihara et al. | |

FOREIGN PATENT DOCUMENTS

| | | |
|---|---|---|
| JP | 2006-248667 | 9/2006 |
| JP | 2009-214200 | 9/2009 |

OTHER PUBLICATIONS

U.S. Appl. No. 13/293,517 of Masato Ogawa et al., filed Nov. 10, 2011.
U.S. Appl. No. 13/306,029 of Masahiko Yamada et al., filed Nov. 29, 2011.

* cited by examiner

*Primary Examiner* — Juanita D Jackson
(74) *Attorney, Agent, or Firm* — Cooper & Dunham LLP

(57) ABSTRACT

An image forming apparatus includes a sheet feed device to feed a sheet along a sheet feed path, a sheet cutting device including a cutter and a cutter holder to cut the sheet to a desired length, a controller to control the sheet feed device and the cutter holder. The cutter holder holds the cutter and is reciprocally movable in a width direction of the sheet perpendicular to a sheet feed direction. The cutter holder, after cutting the sheet, is movable in the width direction with the cutter holder retracted away from the sheet feed path in a thickness direction of the sheet perpendicular to both the sheet feed direction and the width direction. The controller controls the sheet feed device to feed the sheet while the cutter holder moves in the width direction with the cutter holder retracted away from the sheet feed path in the thickness direction.

5 Claims, 11 Drawing Sheets

IMAGE FORMING APPARATUS INCLUDING SHEET CUTTING DEVICE

CROSS-REFERENCE TO RELATED APPLICATIONS

This patent application is based on and claims priority pursuant to 35 U.S.C. §119 to Japanese Patent Application No. 2010-269389, filed on Dec. 2, 2010, in the Japan Patent Office, the entire disclosure of which is hereby incorporated by reference herein.

TECHNICAL FIELD

This disclosure relates to an image forming apparatus, and more specifically to an image forming apparatus including a sheet cutting device to cut a rolled sheet to a desired length.

DESCRIPTION OF THE BACKGROUND ART

Image forming apparatuses are used as printers, facsimile machines, copiers, plotters, or multi-functional devices having two or more of the foregoing capabilities. As a conventional type of image forming apparatus, an image forming apparatus is known that feeds a long-size rolled sheet (hereinafter, rolled sheet) in a certain feed direction (hereinafter, sheet feed direction) to form an image on the rolled sheet.

The image forming apparatus typically has a sheet cutting device to cut the rolled sheet to a desired length by moving a cutter in a direction perpendicular to the sheet feed direction (hereinafter, width direction). The cutter used in the sheet cutting device may be, for example, a pair of circular blades to cut sheets of different thicknesses or materials. In particular, recently, such cutters are widely used in inkjet-type image forming apparatuses capable of forming images on sheets of different thicknesses or materials.

Such a conventional sheet cutting device having the cutter formed with the pair of circular blades needs to return a cutter holder holding the cutter to an initial position (home position) in preparation for the next sheet cutting. At this time, if a forward path along which the cutter moves to cut the sheet is identical to a backward path along which the cutter moves to return to the home position, the cutter contacts the already-cut sheet on the backward path, thus hampering movement of the cutter holder (so-called "cut jam") or causing other failure.

To prevent such a cut jam or other failure, for example, JP-2009-214200-A proposes an image forming apparatus including a sheet cutting device in which the backward path of the cutter formed with the pair of circular blades differs from the forward path of the cutter. Relative to the forward path, the backward path is arranged at a downstream side in the sheet feed direction in which the sheet is fed along a sheet feed path and at a position away from a leading edge of a subsequent divided sheet upstream from the cutter in the sheet feed direction. Specifically, after the cutter finishes the cutting operation, the cutter holder is tilted toward the downstream side in the sheet feed direction around a guide member for guiding the movement of the cutter holder. Thus, the position of the cutter moving along the backward path in the sheet feed direction is shifted to the downstream side in the sheet feed direction relative to the position of the cutter moving along the forward path.

Such a configuration can prevent the cutter from contacting the already-cut sheet on the backward path, thus preventing a cut jam. However, in the image forming apparatus, the cutter holder still remains on the sheet feed path after cutting operation. As a result, a subsequent sheet cannot be fed from the rolled sheet until the cutter and the cutter holder return to the home position, thus hampering gains in productivity.

BRIEF SUMMARY

In an aspect of this disclosure, there is provided an improved image forming apparatus including a sheet feed device, a sheet cutting device, and a controller. The sheet feed device feeds a sheet along a sheet feed path. The sheet cutting device includes a cutter and a cutter holder to cut the sheet to a desired length. The cutter includes opposed blades opposing each other to cut the sheet therebetween. The cutter holder holds the cutter and is reciprocally movable in a width direction of the sheet perpendicular to a sheet feed direction in which the sheet is fed along the sheet feed path. The controller controls the sheet feed device and the cutter holder. The cutter holder, after cutting the sheet with the cutter, is movable in the width direction of the sheet with the cutter holder retracted away from the sheet feed path in a thickness direction of the sheet perpendicular to both the sheet feed direction and the width direction of the sheet. The controller controls the sheet feed device to feed the sheet while the cutter holder moves in the width direction of the sheet with the cutter holder retracted away from the sheet feed path in the thickness direction of the sheet.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
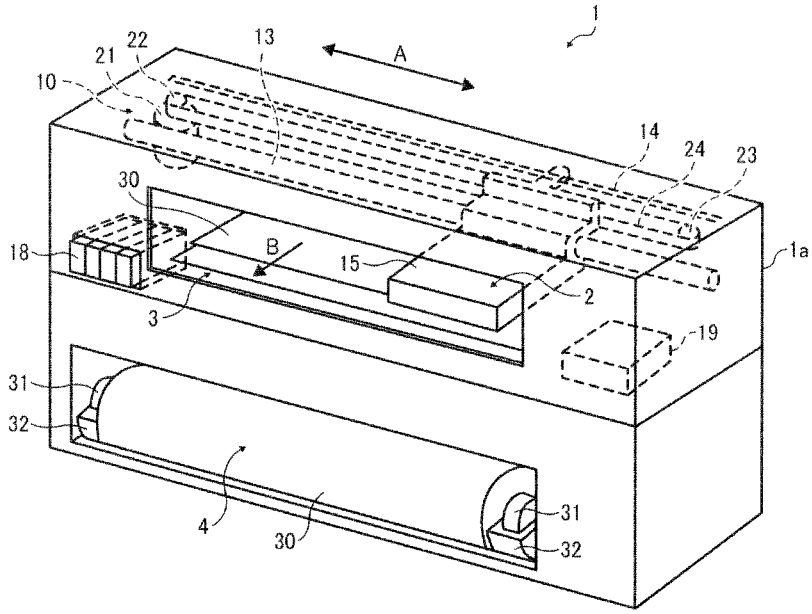
FIG. 1 is a schematic perspective view of an inkjet recording apparatus according to an exemplary embodiment of this disclosure.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIGS. 1 to 15 show an image forming apparatus according to exemplary embodiments of the present disclosure. In FIGS. 1 to 15, an inkjet recording apparatus is illustrated as an example of the image forming apparatus.

In FIG. 1, an inkjet recording apparatus 1 serving as the image forming apparatus is a serial-type inkjet recording apparatus that moves an inkjet head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image. The image forming apparatus is not limited to the serial-type inkjet recording apparatus but may be, for example, a line-type inkjet recording apparatus having a recording head in which multiple nozzles are arranged across a substantially whole area in the width direction of a sheet to record an image on the sheet without scanning in the width direction.

Figure 11:
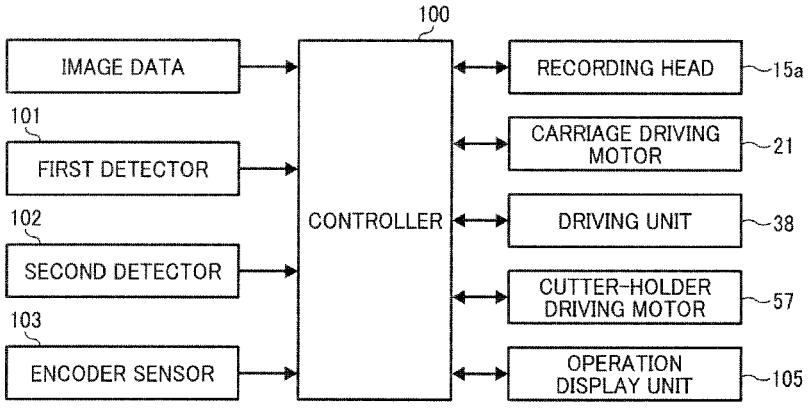
FIG. 11 is a block diagram of a control configuration of an inkjet recording apparatus according to an exemplary embodiment of this disclosure.

The inkjet recording apparatus 1 includes an image forming section 2 serving as an image forming device, a sheet feed section 3 serving as a sheet feed device, a rolled sheet storage section 4, a sheet cutting device 5, and a controller 100 (see FIG. 11). The image forming section 2, the sheet feed section 3, the rolled sheet storage section 4, the sheet cutting device 5, and the controller 100 are disposed within an apparatus main unit 1*a*. In this exemplary embodiment, the controller 100 serves as a control device.

In the image forming section 2, a guide rod 13 and a guide rail 14 are extended between side plates, and a carriage 15 is supported by the guide rod 13 and the guide rail 14 so as to be slidable in a direction indicated by an arrow A.

The carriage 15 holds recording heads 15*a* (see FIG. 3) to eject ink droplets of, e.g., black (K), yellow (Y), magenta (M), and cyan (C). Sub tanks are integrally provided with the corresponding recording heads 15*a* to supply color inks to the respective recording heads 15*a*.

Figure 12:
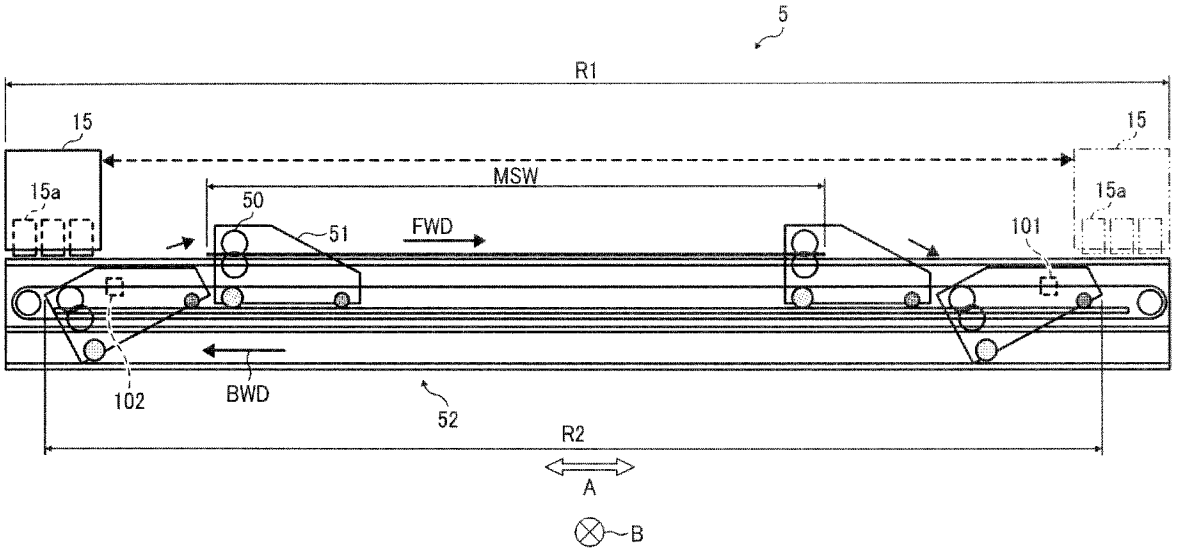
FIG. 12 is a schematic view of ranges of movement of a carriage and the cutter holder.

A main scanning mechanism 10 moves the carriage 15 for scanning in a main scanning direction, that is, the sheet width direction indicated by the arrow A. Specifically, as illustrated in FIG. 12, the carriage 15 is movable in the sheet width direction between a carriage home position (indicated by a solid line in FIG. 12) and a maintenance ejection position (indicated by a broken line in FIG. 12). The carriage home position and the maintenance ejection position of the carriage 15 are disposed away from each other in the sheet width direction outside a range of a maximum sheet width MSW. Hereinafter, the range of movement of the carriage 15 in the sheet width direction (indicated by an arrow R1 in FIG. 12) may be referred to as "carriage movement range". In this exemplary embodiment, the maintenance ejection position corresponds to a first position of the carriage 15, and the carriage home position corresponds to a second position or home position of the carriage 15.

The main scanning mechanism 10 includes a carriage driving motor 21 disposed at a first end in the sheet width direction, a driving pulley 22 rotated by the carriage driving motor 21, a driven pulley 23 disposed at a second end opposite the first end in the sheet width direction, and a belt member 24 looped around the driving pulley 22 and the driven pulley 23. A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction.

To detect a main scanning position of the carriage 15 in the main scanning direction, an encoder sheet is disposed along the sheet width direction in which the carriage 15 moves. An encoder sensor 103 (see FIG. 11) disposed at the carriage 15 reads the encoder sheet to detect the main scanning position of the carriage 15.

In a recording area of a main scanning region of the carriage 15, the rolled sheet 30 is intermittently fed by the sheet feed section 3 in a direction perpendicular to the sheet width direction, that is, the sheet feed direction indicated by an arrow B in FIG. 1.

Outside the movement range R1 of the carriage 15 in the sheet width direction or at a first end side of the main scanning region of the carriage 15, the main cartridges 18 are removably mounted to the apparatus main unit 1*a* to store the respective color inks to be supplied to the sub tanks of the recording heads 15*a*. At a first end side of the carriage movement range R1, that is, at a side proximal to the maintenance ejection position (right side in FIG. 12), a droplet receptacle is disposed to store ink droplets not used for a resultant image but ejected for discharging viscosity-increased ink during maintenance ejection. Under certain conditions, each of the recording heads 15*a* performs the maintenance ejection at the maintenance ejection position to maintain and recover desired ejection performance.

Figure 3:
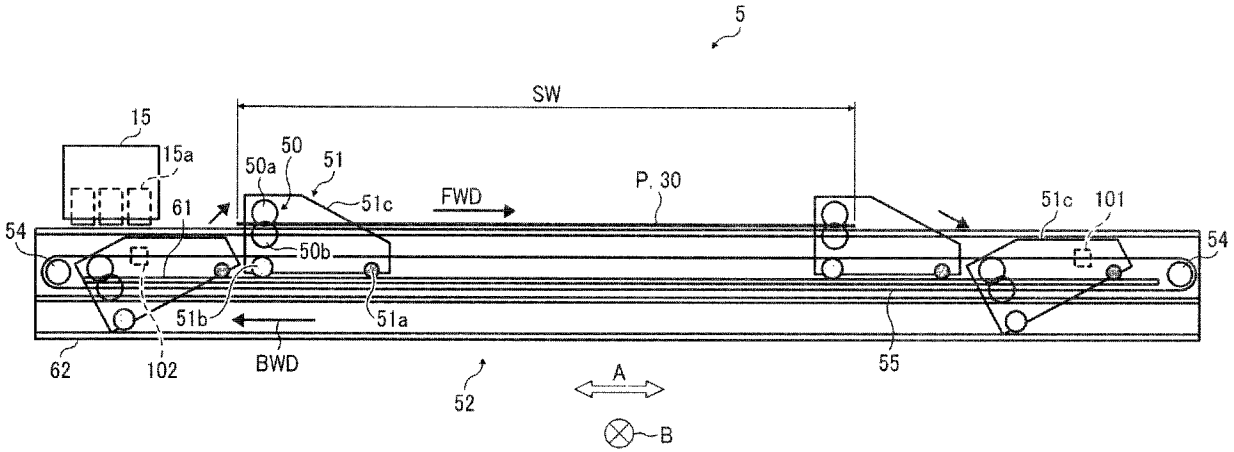
FIG. 3 is a schematic back view of an sheet cutting device according to an exemplary embodiment of this disclosure.

At a second end side of the carriage movement range R1, that is, a side proximal to the carriage home position (left side in FIG. 12), a maintenance unit 19 (see FIG. 1) is disposed to maintain and recover conditions of the recording heads 15*a* (see FIG. 3). The maintenance unit 19 includes, e.g., caps to seal respective nozzle faces of the recording heads 15*a* and a wiper blade serving as a blade member to wipe the nozzle faces of the recording heads 15*a*. Alternatively, for example, the above-described droplet receptacle may be disposed at the second side proximal to the carriage home position and included in the maintenance unit 19 with the caps and the wiper blade. Furthermore, two droplet receptacles may be disposed at both the carriage-home-position side and the maintenance-ejection-position side.

The rolled sheet storage section 4 serves as a sheet feed unit into which the rolled sheet 30 serving as a sheet material for image recording is set. As the rolled sheet 30, rolled sheets of different widths can be set to the rolled sheet storage section 4. The rolled sheet 30 includes a sheet shaft, and flanges 31 are mounted at opposite ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumference of the flanges 31 to feed the rolled sheet 30 to the sheet feed path.

Figure 2:
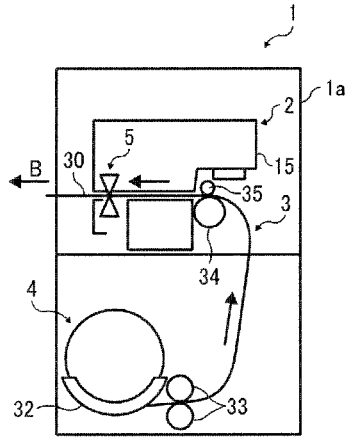
FIG. 2 is a schematic side view of the inkjet recording apparatus illustrated in FIG. 1.

As illustrated in FIG. 2, the sheet feed section 3 includes the pair of sheet feed rollers 33, the registration roller 34, the registration pressing roller 35, and a driving unit 38. The driving unit 38 (see FIG. 11) includes, for example, a driving motor to drive the pair of sheet feed rollers 33, the registration roller 34, and the registration pressing roller 35. The pair of sheet feed rollers 33 feeds the rolled sheet 30 from the rolled sheet storage section 4 to the sheet feed path. The registration roller 34 and the registration pressing roller 35 are disposed upstream from the image forming section 2 in the sheet feed direction to feed the rolled sheet 30 to the sheet cutting device 5 via the image forming section 2. In this exemplary embodiment, the sheet feed section 3 including the driving unit 38 serves as a sheet feed device.

After the rolled sheet 30 is fed from the rolled sheet storage section 4, the sheet feed section 3 feeds the rolled sheet 30 forward (toward the left side in FIG. 2) from the rear side (right side in FIG. 2) of the apparatus main unit 1*a* to the recording area below the image forming section 2. When the rolled sheet 30 is fed to the recording area, the carriage 15 reciprocally moves back and forth in the sheet width direction and the recording heads 15*a* (see FIG. 3) eject ink droplets in accordance with image information. In addition, while the rolled sheet 30 is intermittently fed forward, the recording heads 15*a* repeatedly eject ink droplets onto the rolled sheet 30 to record lines of a desired image on the rolled sheet 30. Thus, the whole image is formed on the rolled sheet 30 in accordance with the image information.

After image formation, the sheet cutting device 5 cuts the rolled sheet 30 to a desired length, and the cut sheet is discharged to a sheet output tray at the front side of the apparatus main unit 1*a*.

Next, the sheet cutting device 5 in this exemplary embodiment is described with reference to FIGS. 3 to 7.

FIG. 3 is a schematic view of the sheet cutting device 5 seen from the back side of the apparatus main unit 1*a*.

The sheet cutting device 5 is disposed downstream from the image forming section 2 in the sheet feed direction (see FIG. 2) and has a cutter 50, a cutter holder 51, and a guide member 52 as illustrated in FIG. 3.

The cutter 50 is formed with circular blades 50*a* and 50*b*. The circular blades 50*a* and 50*b* are disposed opposing each other and rotatably held by the cutter holder 51. The circular blades 50*a* and 50*b* rotate with movement of the cutter holder 51 in the sheet width direction indicated by the arrow A in FIG. 2. In other words, the cutter 50 rotates the circular blades 50*a* and 50*b* to cut the rolled sheet 30 and is capable of cutting, e.g., a relatively thick rolled sheet. Additionally, the cutter 50 is formed with the circular blades, thus preventing a failure, such as uneven wearing of a particular portion as in a stationary blade. It is to be noted that the number of circular blades is not limited to two and may be three or more. The circular blades 50*a* and 50*b* in this exemplary embodiment serve as cutting portions.

The cutter holder 51 is reciprocally movable back and forth within a range of movement in the sheet width direction (hereinafter may be referred to as "cutter-holder movement range") indicated by an arrow R2 in FIG. 12. When the cutter holder 51 moves along a forward path (indicated by an arrow FWD in FIG. 12) from the second end side to the first end side of the apparatus main unit 1*a* (see FIG. 1), the cutter 50 cuts the rolled sheet 30. By contrast, when the cutter holder 51 moves along a backward path (indicated by an arrow BWD in FIG. 12) from the first end side to the second end side of the apparatus main unit 1*a* (see FIG. 1), the cutter holder 51 returns to an initial position (hereinafter, cutter home position) with the cutter holder 51 retracted from the sheet feed path downward in a thickness direction (sheet thickness direction) of the sheet, that is, the vertical direction in FIG. 12. As a result, on the backward path, the cutter holder 51 is separated from the sheet feed path (indicated by a solid line P in FIG. 3) so as not to block the sheet feed path.

The cutter holder 51 includes a first detector 101 and a second detector 102, such as first and second micro switches, disposed at the opposed ends in the cutter-holder movement range R2 to detect the cutter holder 51, and the controller 100 controls the cutter holder 51 based on a position of the cutter holder 51 detected by the first detector 101 and the second detector 102.

In this exemplary embodiment, the above-described forward path serves as a first path of the cutter holder and the above-described backward path serves as a second path of the cutter holder. The configuration of the cutter holder 51 is as follows.

The cutter holder 51 has a driving roller 51*a* and a driven roller 51*b*, and holds the cutter 50 inside. The driving roller 51*a* is connected to a wire 55 extended between a pair of pulleys 54 at opposite ends of the apparatus main unit 1*a* in the sheet width direction. The wire 55 circulates in the sheet width direction via the pair of pulleys 54 rotated by a cutter-holder driving motor 57 (see FIG. 11). As a result, the driving roller 51*a* is rotationally moved on an upper guide rail 61 in accordance with the circulation of the wire 55. The cutter holder 51 is movable in the sheet width direction in accordance with the movement of the driving roller 51*a*.

The driven roller 51*b* is rotatably disposed at a position away from the driving roller 51*a* in the sheet width direction. The driven roller 51*b* moves on the upper guide rail 61 along the forward path of the cutter holder 51 and on a lower guide rail 62 along the backward path. In other words, during the movement of the cutter holder 51, the driven roller 51*b* functions as a positioning member to position the cutter holder 51 with respect to the upper guide rail 61 and the lower guide rail 62. It is to be noted that the positioning member of the cutter holder 51 is not limited to the driven roller 51*b* but may be, for example, a circular-arc protrusion.

On switching between the forward path and the backward path, the cutter holder 51 pivots in the vertical direction around the driving roller 51*a*. Thus, the cutter holder 51 switches between a first position with which the cutter holder 51 cuts the rolled sheet 30 along the forward path and a second position with which the cutter holder 51 is retracted from the sheet feed path.

Figure 4A:
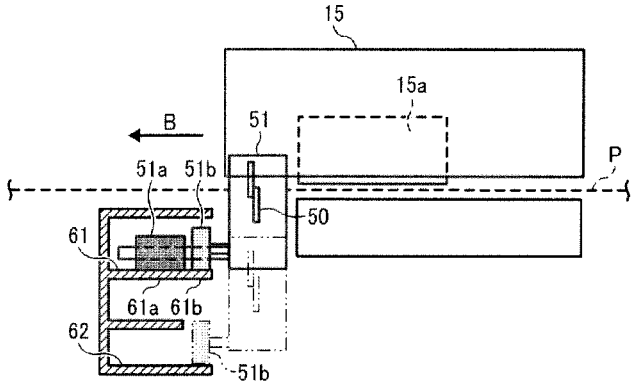
FIG. 4A is a cross-sectional side view of a portion of the sheet cutting device.

As illustrated in FIG. 4A, the cutter holder 51 is disposed within a range having the width of the carriage 15 in the sheet feed direction. In other words, the cutter-holder movement range partially overlaps the carriage movement range, thus reducing the width of the apparatus main unit 1*a* in the sheet feed direction. In the above-described arrangement of this exemplary embodiment, when the carriage 15 is placed at the carriage home position or the maintenance ejection position, the cutter holder 51 moves along the forward path, thus preventing the cutter holder 51 from interfering with the carriage 15. The control of the movement of the cutter holder 51 is performed by the controller 100 as described below. In FIG. 4A, a broken line P extending in the direction indicated by the arrow B represents the sheet feed path.

In this exemplary embodiment, as illustrated in FIG. 4A, the cutter holder 51 is disposed within the range corresponding to the width of the carriage 15 in the sheet feed direction. Alternatively, for example, the cutter holder 51 may be disposed at a position away from the carriage 15 at the upstream or downstream side in the sheet feed direction.

The driving roller 51*a* and the driven roller 51*b* are offset from each other in the sheet feed direction indicated by the arrow B. Specifically, the driven roller 51*b* is arranged upstream from the driving roller 51*a* in the sheet feed direction. As a result, with the driving roller 51*a* held on the upper guide rail 61, the driven roller 51*b* becomes movable between the upper guide rail 61 and the lower guide rail 62, thus allowing the cutter holder 51 to pivot around the driving roller 51*a*.

As illustrated in FIG. 3, the cutter holder 51 has a slanted face 51*c* slanted at a predetermined angle from the sheet feed path (indicated by the solid line P) toward the vertical direction. The slant angle of the slanted face 51*c* is set so that the slanted face 51*c* is parallel to the sheet feed path when the cutter holder 51 moves along the backward path.

As illustrated in FIG. 3, the guide member 52 guides the movement of the cutter holder 51 in the sheet width direction, and includes the upper guide rail 61, extending in the sheet width direction for a length that is at least longer than the width (sheet feed width) of the sheet feed path indicated by an arrow SW, and the lower guide rail 62 disposed away from the sheet feed path downward in the vertical direction. The guide member 52 forms the forward path of the cutter holder 51 on the upper guide rail 61 and the backward path of the lower guide rail 62 on the lower guide rail 62. In this exemplary embodiment, the upper guide rail 61 and the lower guide rail 62 are formed as a single member (the guide member 52). Alternatively, the upper guide rail 61 and the lower guide rail 62 may be formed as separate members.

Figure 4B:
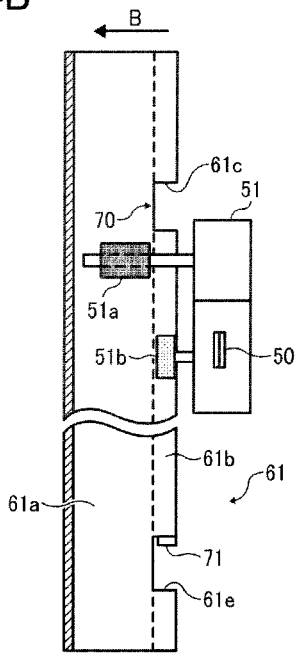
FIG. 4B is a cross-sectional plan view of a portion of the sheet cutting device.

As illustrated in FIGS. 4A and 4B, the upper guide rail 61 has a driving-roller guide area 61*a* to guide the driving roller 51*a* in the sheet width direction and a driven-roller guide area 61*b* to guide the driven roller 51*b* so that the cutter holder 51 moves along the forward path. In this exemplary embodiment, the driving-roller guide area 61*a* and the driven-roller guide area 61*b* are formed as a single rail, that is, the upper guide rail 61. Alternatively, the driving-roller guide area 61*a* and the driven-roller guide area 61*b* may be formed as separate rails.

Figure 6:
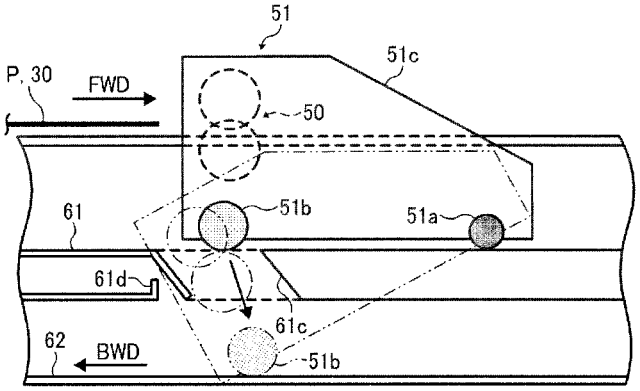
FIG. 6 is a schematic view of the cutter holder shifting to a backward path.

At a first end side of the driven-roller guide area 61*b* in the sheet width direction, a first connection path 61*c* is formed to switch the path of the cutter holder 51 from the forward path to the backward path. As illustrated in FIG. 6, the first connection path 61*c* is formed at the upper guide rail 61 so as to connect the forward path (indicated by an arrow FWD) on the upper guide rail 61 to the backward path (indicated by an arrow BWD) on the lower guide rail 62. Specifically, a predetermined portion of the upper guide rail 61 is cut out at the first end side in the sheet width direction and folded so as to slant downward at a certain angle, thus forming the first connection path 61*c*. Thus, the first connection path 61*c* allows the driven roller 51*b* to move from the upper guide rail 61 to the lower guide rail 62 after the rolled sheet is cut with the cutter 50. A lower end portion 61*d* of the upper guide rail 61 adjacent to the first connection path 61*c* is folded upward so as not to contact the driven roller 51*b* moving along the backward path.

Figure 5:
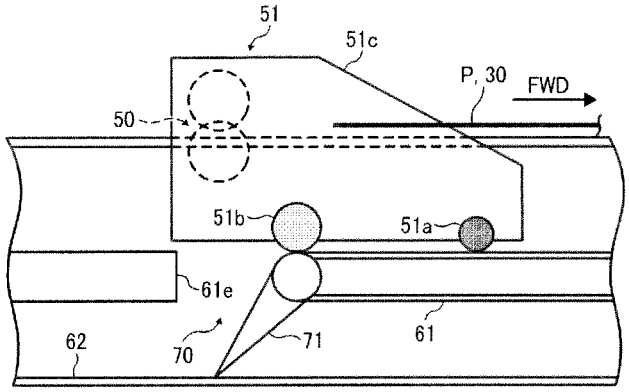
FIG. 5 is a schematic view of a cutter holder of the sheet cutting device having returned to a rolled-sheet cutting area.

As illustrated in FIG. 5, a moving mechanism 70 is disposed at a second end side of the driven-roller guide area 61*b* opposite the first end side in the sheet width direction. When the cutter holder 51 moves from the cutter home position indicated by a solid line in FIG. 10 to the opposite end in the sheet width direction, the moving mechanism 70 moves the driven roller 51*b* from the lower guide rail 62 to the upper guide rail 61, that is, returns the cutter holder 51 to a cutting area (rolled-sheet cutting area) of the rolled sheet.

The moving mechanism 70 includes a second connection path 61*e* to connect the backward path on the lower guide rail 62 to the forward path on the upper guide rail 61, and a switching hook 71 disposed adjacent to the second connection path 61*e* at the upper guide rail 61.

The second connection path 61*e* is formed by cutting out a predetermined portion of the upper guide rail 61 at the second end side in the sheet width direction (see FIG. 4B).

Figure 9:
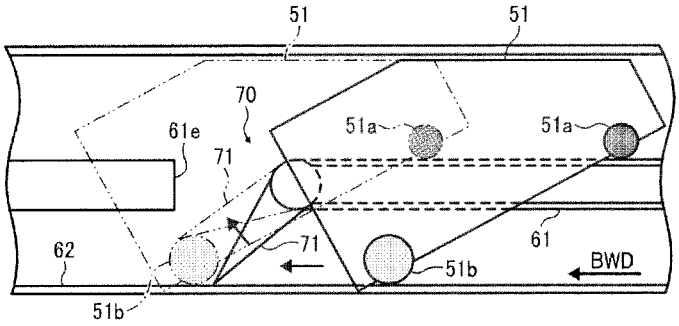
FIG. 9 is a schematic view of the cutter holder returning from the backward path to a home position of the cutter holder.
Figure 10:
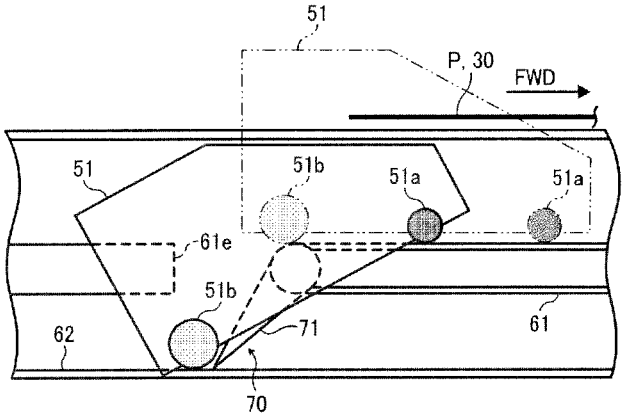
FIG. 10 is a schematic view of the cutter holder returning to the rolled-sheet cutting area.

The switching hook 71 pivots between the backward path and the second connection path 61*e* and is constantly urged downward by an urging member, e.g., a coil spring, so that a tip of the switching hook 71 contacts the lower guide rail 62. As a result, as illustrated in FIG. 9, when the cutter holder 51 moves along the backward path (indicated by an arrow BWD) to the second end side in the sheet width direction, the driven roller 51*b* contacts the switching hook 71 to pivot the switching hook 71 as indicated by a broken line. In this state, when the driven roller 51*b* further moves to the second end side in the sheet width direction, the switching hook 71 is separated from the driven roller 51*b* and returned by the urging member to an initial position, that is, a position indicated by a solid line in FIG. 9. At the initial position indicated by the solid line in FIG. 9, the switching hook 71 is tilted at a predetermined angle. Thus, as illustrated in FIG. 10, when the cutter holder 51 returns from the backward path to the forward path, the driven roller 51*b* can be moved from the lower guide rail 62 to the upper guide rail 61 via the switching hook 71. The switching hook 71 may be, for example, a leaf spring. In such a case, the urging member is not necessary.

The lower guide rail 62 guides the driven roller 51*b* of the cutter holder 51 moving along the backward path.

Next, operation of the sheet cutting device 5 is described with reference to FIGS. 5 to 10.

As illustrated in FIG. 10, before the rolled sheet 30 is cut, the cutter holder 51 is placed at the cutter home position (indicated by the solid line in FIG. 10) at the second end side in the sheet width direction. Next, when an instruction for sheet cutting is received, by rotating the driving roller 51*a* via the wire 55 (see FIG. 3), the cutter holder 51 is moved from the cutter home position to the rolled-sheet cutting area (a position indicated by a broken line in FIG. 10), and then moved along the forward path (indicated by an arrow FWD in FIG. 10) to the first end side in the sheet width direction. At this time, the cutter 50 cuts the rolled sheet 30 in accordance with movement of the cutter holder 51.

Figure 7:
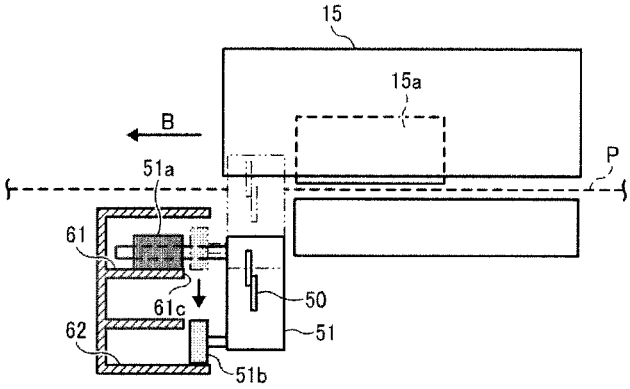
FIG. 7 is a cross-sectional side view of the portion of the sheet cutting device illustrated in FIG. 4A when the cutter holder shifts to the backward path.

Next, as illustrated in FIG. 6, when the cutter holder 51 moves along the forward path (indicated by an arrow FWD) to the first end side in the sheet width direction across the sheet feed path (indicated by a solid line P), the cutting of the rolled sheet 30 is finished. After the cutter holder 51 moves to the first end side in the sheet width direction, the cutter holder 51 pivots downward in the vertical direction around the driving roller 51*a* under its own weight. Specifically, when the driven roller 51*b* moving on the upper guide rail 61 arrives at the first connection path 61*c*, the driven roller 51*b* moves from the upper guide rail 61 to the lower guide rail 62 via the first connection path 61*c*. At this time, as illustrated in FIG. 7, with the driving roller 51 a retained on the upper guide rail 61, only the driven roller 51*b* moves to the lower guide rail 62 under its own weight. As a result, in FIG. 7, the cutter holder 51 overlapping the sheet feed path indicated by a broken line P pivots to take a position with which the cutter holder 51 is movable along the backward path, that is, the position (indicated by a broken line in FIG. 6) with which the cutter holder 51 is retracted from the sheet feed path.

Figure 8:
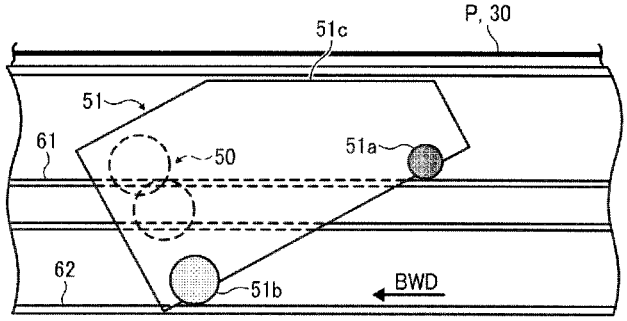
FIG. 8 is a schematic view of the cutter holder moving along the backward path.

Then, based on a position detected by the first detector 101 at the first end side in the cutter-holder movement area R2 (see FIG. 12), the wire 55 (see FIG. 3) is circulated in reverse to rotate the driving roller 51*a* in reverse, that is, in a direction opposite a direction in which the driving roller 51*a* rotates on the forward path. Thus, as illustrated in FIG. 8, with the position retracted from the sheet feed path indicated by the solid line P, the cutter holder 51 moves along the backward path (indicated by an arrow BWD) to the second end side in the sheet width direction. At this time, the slanted face 51*c* is parallel to the sheet feed path and, unlike on the forward path, the cutter holder 51 is retracted downward from the sheet feed path. Thus, when the cutter holder 51 moves along the backward path, the rolled sheet 30 can be fed along the sheet feed path.

Next, as illustrated in FIG. 9, when the cutter holder 51 moves to the second end side in the sheet width direction and arrives at a position adjacent to the moving mechanism 70, the driven roller 51*b* contacts the switching hook 71. With the movement of the cutter holder 51, the driven roller 51*b* pushes up the switching hook 71 as indicated by a broken line in FIG. 9, and moves from the backward path side (the right side of the switching hook 71 in FIG. 9) to the second end side in the sheet width direction, that is, the side of the second connection path 61*e* (the left side of the switching hook 71 in FIG. 9). When the driven roller 51*b* moves to the side of the second connection path 61*e*, the switching hook 71 is separated from the driven roller 51*b* and returned by the urging member to the initial position, that is, the position indicated by the solid line in FIG. 9.

Thus, the reciprocal movement of the cutter holder 51 in the sheet width direction is finished. If the rolled sheet 30 is subsequently fed, the above-described reciprocal movement is repeated.

Next, a configuration of the controller 100 is described with reference to FIG. 11.

As illustrated in FIG. 11, the first detector 101, the second detector 102, the encoder sensor 103, the recording heads 15*a*, the carriage driving motor 21, the driving unit 38, the cutter-holder driving motor 57, and an operation-and-display unit 105 are connected to the controller 100. The controller 100 includes a micro computer including, for example, a central processing unit (CPU), a random access memory (RAM), a read-only memory (ROM), and an input-output interface.

In this exemplary embodiment, various motors are controlled by a single controller, that is, the controller 100. Alternatively, the controller 100 may be formed of two or more controllers to control different motors. For example, the controller 100 may be formed of a first controller to control the recording heads 15*a*, the carriage driving motor 21, and the driving unit 38, and a second controller to control the cutter-holder driving motor 57. Furthermore, the above-described first controller may be formed of an image formation controller to control the recording heads 15*a* and the carriage driving motor 21 and a sheet feed controller to control the driving unit 38.

In this exemplary embodiment, the first detector 101 is disposed at the first end side (right side in FIG. 12) of the cutter-holder movement area R2 to detect arrival of the cutter holder 51 at the first end of the cutter-holder movement area R2. The second detector 102 is disposed at the second end side (left side in FIG. 12) of the cutter-holder movement area R2 to detect arrival of the cutter holder 51 at the second end of the cutter-holder movement area R2. As described above, the encoder sensor 103 is mounted at the carriage 15 to read the encoder sheet to detect the main scanning position of the carriage 15. Signals representing detection results of the first detector 101, the second detector 102, and the encoder sensor 103 are input to the controller 100.

The operation-and-display unit 105 is disposed at a certain position of the apparatus main unit 1*a* to receive instructions of operation requests from a user and display messages, such as error messages.

The controller 100 creates data for recording a desired image on the rolled sheet 30 in accordance with image information transferred from, e.g., an external information processing device, outputs the data to the recording heads 15*a*, and controls driving of the recording heads 15*a*. The controller 100 also controls the carriage driving motor 21 and the carriage driving motor 21, as well as the recording heads 15*a*. As described above, the controller 100 controls the recording heads 15*a*, the carriage driving motor 21, and the driving unit 38 to eject ink droplets at proper timings to record a desired image on a recording area of the rolled sheet 30.

When the controller 100 determines based on a signal input from the encoder sensor 103 that the carriage 15 is placed at the carriage home position or the maintenance ejection position, the controller 100 moves the cutter holder 51 to the first end in the sheet width direction along the forward path (see FIG. 3) to cut the rolled sheet 30.

When the cutter holder 51 is detected by the first detector 101 after the cutting operation, the controller 100 rotates the cutter-holder driving motor 57 in reverse to move the cutter holder 51 to the second side in the sheet width direction along the backward path with the cutter holder 51 retracted from the sheet feed path. At this time, the controller 100 controls the driving unit 38 so that the rolled sheet 30 can be fed to the downstream side in the sheet feed direction while the cutter holder 51 moves along the backward path. Thus, while the cutter holder 51 moves along the backward path, the rolled sheet 30 can be fed for, e.g., image recording.

The controller 100 determines whether or not a predetermined non-activation time of nozzles has elapsed. If the controller 100 determines that the predetermined non-activation time has elapsed, the controller 100 causes the carriage 15 to move the maintenance ejection position and the recording heads 15*a* to perform maintenance ejection. At this time, when a cut position SCP of the rolled sheet 30 at which the rolled sheet 30 is cut by the cutter 50 (hereinafter, sheet cut position SCP) arrives at a cutting position CP of the cutter 50 at which the cutter 50 cuts the rolled sheet 30 (hereinafter, cutter position CP), the above-described maintenance ejection and sheet cutting operation can be simultaneously performed. It is to be noted that the maintenance ejection may be performed when the number of times nozzles are used for image recording reaches a predetermined threshold.

Next, control procedures of image recording and movement of the cutter holder 51 by the controller 100 are described with reference to FIGS. 13A, 13B, and 14.

The control procedure illustrated in FIGS. 13A and 13B relates to image recording (hereinafter, may be referred to as printing) performed on a second or subsequent sheet after image recording on a first sheet. The roller sheet 30 has a margin area between the first and second sheets, which is omitted for simplicity in FIG. 14. In this exemplary embodiment, as illustrated in FIG. 14, a case is described of a print mode in which an image of a print width L0 can be printed by a single scanning of the carriage 15.

Figure 13A:
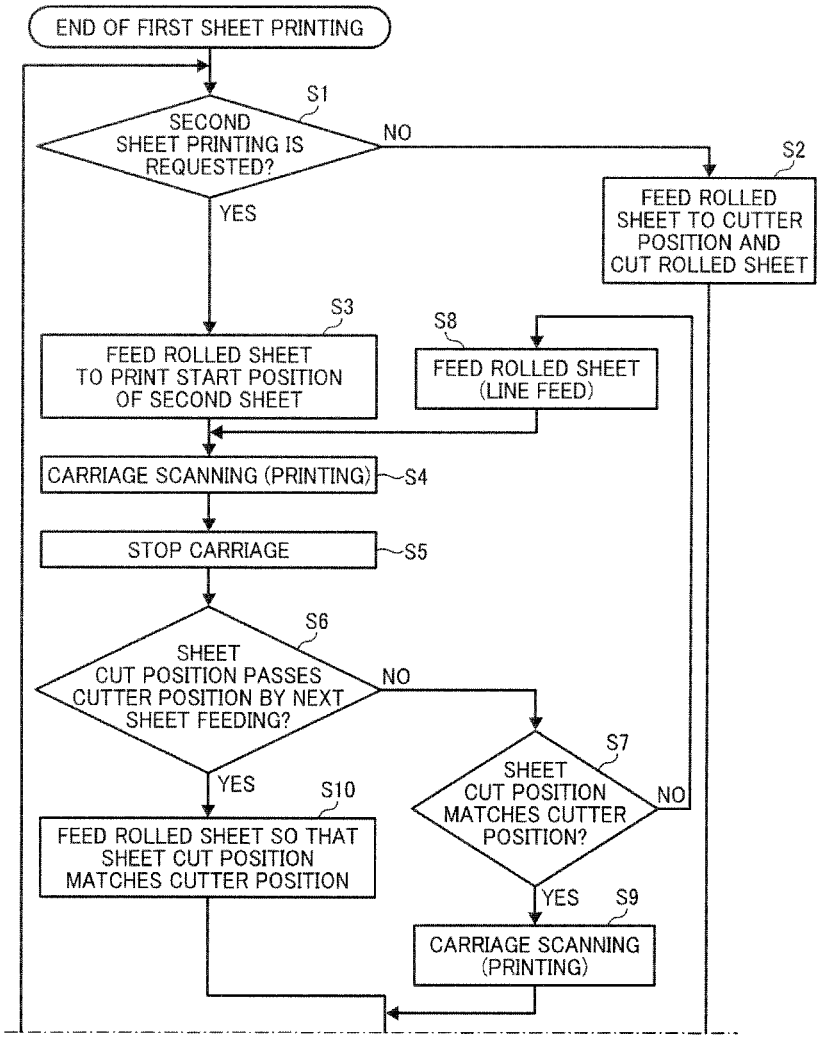
FIGS. 13A and 13B are a flow chart of a control procedure of image recording on a second or subsequent sheet and movement of the cutter holder performed by a controller according to an exemplary embodiment of this disclosure.
Figure 13B:
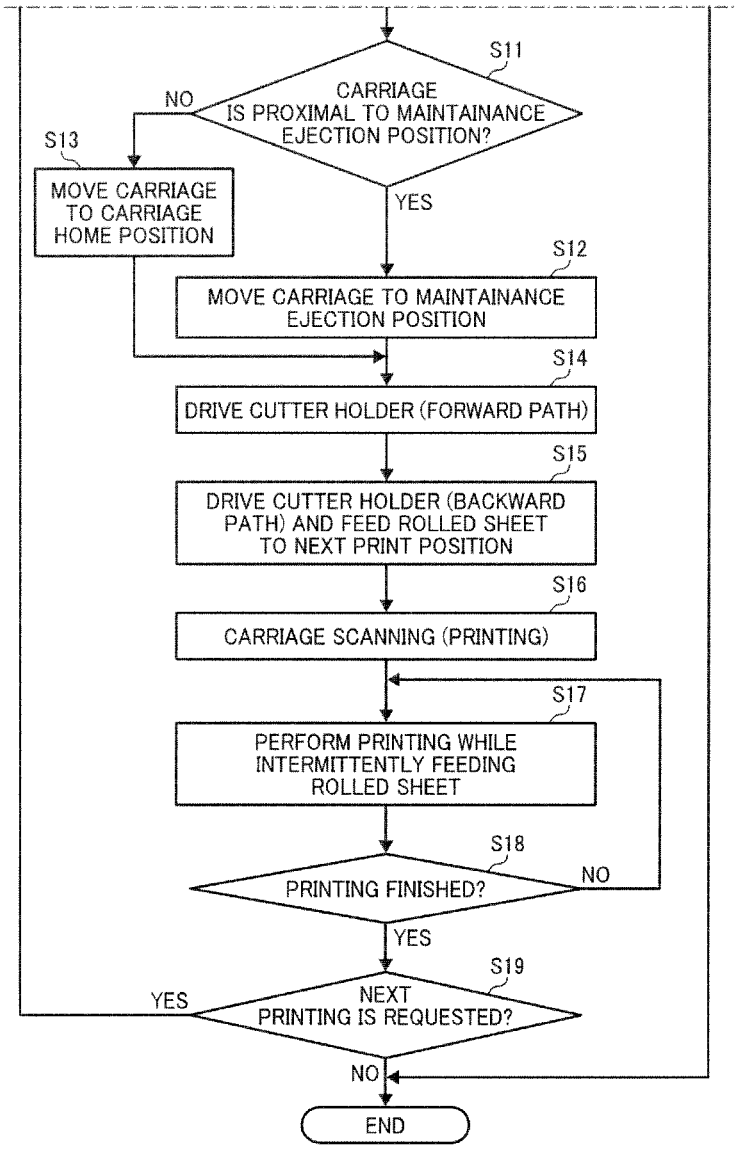
Figure 14:
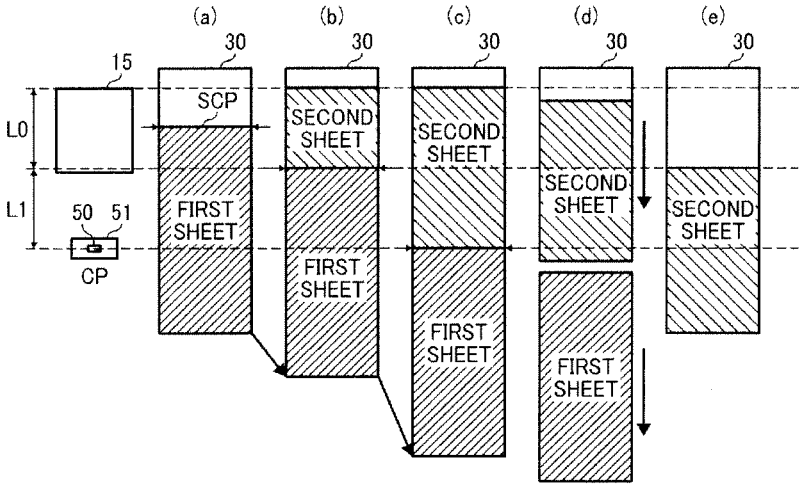
FIG. 14 is a schematic view of states of a rolled sheet during execution of the control procedure illustrated in FIG. 13.

As illustrated in FIG. 13A, after the end of printing on the first sheet, at 51 the controller 100 determines whether or not printing on the second sheet is requested. If printing on the second sheet is not requested (NO at 51), the controller 100 controls the sheet feed section 3 to feed the rolled sheet 30 till the sheet cut position SCP of the rolled sheet 30 arrives at the cutter position CP of the cutter 50 (see FIG. 14*c*). At S2, the controller 100 causes the cutter 50 to cut the rolled sheet 30, and terminates the process.

Alternatively, if printing on the second sheet is requested (YES at 51), at S3 the controller 100 controls to feed the rolled sheet 30 to a print start position of the second sheet. At S4, the controller 100 moves the carriage 15 for scanning to record (print) a line (or band) of a desired image and at S5 stops the carriage 15. For example, the rolled sheet 30 is fed from a position illustrated in FIG. 14*a* to a position illustrated in FIG. 14*b*, and at S4 a line of the desired image is printed on the second sheet.

At S6, the controller 100 determines whether or not the sheet cut position SCP of the rolled sheet 30 will pass the cutter position CP of the cutter 50 by the next sheet feeding. If the controller 100 determines that the sheet cut position SCP will not pass the cutter position CP (NO at S6), at S7 the controller 100 also determines whether the sheet cut position SCP will match the cutter position CP. In other words, the controller 100 determines whether or not the sheet cut position SCP will arrive exactly at the cutter position CP by the sheet feeding at S3. If the controller 100 determines that the sheet cut position SCP will not match the cutter position CP (NO at S7), at S8 the controller 100 controls the sheet feed section 3 to feed the rolled sheet 30 for line feed. Then, returning to S4, the controller 100 moves the carriage 15 for scanning to record another line of the image on the second sheet.

If the controller 100 determines that the sheet cut position SCP will match the cutter position CP (YES at S7, see FIG. 14*c*), at S9 the controller 100 causes the carriage 15 to move for scanning to print another line of the image and the process goes to S11.

Alternatively, if the controller 100 determines that the sheet cut position SCP will pass the cutter position CP (YES at S6), at S10 the controller 100 controls the sheet feed section 3 to feed the rolled sheet 30 so that the sheet cut position SCP matches the cutter position CP. For example, if the controller 100 determines that the sheet cut position SCP will pass the cutter position CP if the rolled sheet 30 is fed at a certain feeding distance (hereinafter, prescribed feeding distance S) (YES at S6), the prescribed feeding distance S may be divided into a first feeding distance S1 corresponding to a present distance L1 from the sheet cut position SCP to the cutter position CP and a second feeding distance S2 (=S−S1) obtained by subtracting the first feeding distance from the prescribed feeding distance S, and first, the rolled sheet 30 is fed at the first feeding distance S1 so that the sheet cut position SCP matches the cutter position CP. In such a case, the feeding distance of the rolled sheet 30 in the next feeding operation is set to the second feeding distance S2.

Based on detection results of the encoder sensor 103 (see FIG. 11), at S11 the controller 100 determines whether or not, after the scanning at S4 or S9, the carriage 15 is placed at a side proximal to the maintenance ejection position. In other words, the controller 100 determines which of the maintenance ejection position or the carriage home position is proximal to the present position of the carriage 15.

If the controller 100 determines that the carriage 15 is placed at the side proximal to the maintenance ejection position (YES at S11), at S12 the controller 100 causes the carriage 15 to move to the maintenance ejection position. By contrast, if the controller 100 determines that the carriage 15 is not placed at the side proximal to the maintenance ejection position, that is, the carriage 15 is placed at a side proximal to the carriage home position (NO at S11), at S13 the controller 100 causes the carriage 15 to move to the maintenance ejection position.

In other words, at S12 or S13, the carriage 15 is retracted to a position outside the range of the maximum sheet width MSW. Thus, the cutter holder 51 becomes movable along the forward path without interfering with the carriage 15.

At S14, the controller 100 drives the cutter-holder driving motor 57 so as to rotate in the normal direction, thus driving the cutter holder 51. With the rotation of the cutter-holder driving motor 57, the cutter holder 51 moves along the forward path to perform sheet cutting operation. Thus, as illustrated in FIG. 4*d*, the first sheet is cut out from the rolled sheet 30.

When the cutter holder 51 is detected by the first detector 101, the controller 100 rotates the cutter-holder driving motor 57 in reverse to move the cutter holder 51 along the backward path with the cutter holder 51 retracted from the sheet feed path. Simultaneously, that is, during movement of the cutter holder 51 along the backward path, at S15 the controller 100 feeds the rolled sheet 30 to the next print position (see FIGS. 14*d* and 14*e*). Conventionally, when a cutter holder or unit moves along a backward path, the cutter holder still remains on a sheet feed path. Such a configuration hampers sheet feeding as performed at S15 unless the cutter holder is returned to the home position. By contrast, in this exemplary embodiment, when the cutter holder 51 moves along the backward path, the cutter holder 51 is retracted from the sheet feed path, thus allowing the rolled sheet to be fed as performed at S15.

At S16, as illustrated in FIG. 14*e*, the controller 100 moves the carriage 15 for scanning to record (print) a line of the desired image. At S17, the controller 100 causes the recording heads 15*a* to perform printing while intermittently feeding the rolled sheet 30. At S18, the controller 100 determines whether or not printing on the second sheet has been finished. If the controller 100 determines that printing on the second sheet has not been finished (NO at S18), the process returns to S17 and repeats printing operation.

Alternatively, if the controller 100 determines that printing on the second sheet has been finished (YES at S18), at S19 the controller 100 also determines whether or not the next printing is requested. If the controller 100 determines that the next printing is not requested (NO at S19), the process ends. If the controller 100 determines that the next printing is requested (YES at S19), the process returns to 51 and the controller 100 repeats the subsequent steps.

As described above, in the inkjet recording apparatus 1 according to this exemplary embodiment, while the cutter holder 51, after cutting the rolled sheet 30, moves in the sheet width direction with the cutter holder 51 retracted from the sheet feed path in the thickness direction, the controller 100 can control the sheet feed section 3 to feed the rolled sheet 30.

Thus, while the cutter holder 51 moves after cutting the rolled sheet 30, the subsequent portion of the rolled sheet 30 can be fed, thus increasing the productivity. Additionally, the cutter holder 51 moving after cutting the rolled sheet 30 is fully retracted from the sheet feed path. Such a configuration prevents the cutter 50 from contacting the rolled sheet 30 cut by the cutter 50, thus reliably preventing a cut jam or other failure.

In the inkjet recording apparatus 1 according to this exemplary embodiment, when the carriage 15 is placed at the carriage home position or the maintenance ejection position, the controller 100 performs sheet cutting operation. As a result, even in a configuration in which the cutter-holder movement area overlaps carriage movement range, sheet cutting operation can be performed without interference of the carriage 15 with the cutter holder 51.

In the inkjet recording apparatus 1 according to this exemplary embodiment, in accordance with a position of the carriage 15 placed when the sheet cut position SCP of the rolled sheet 30 arrives at the cutter position CP of the cutter 50, the controller 100 controls the carriage 15 to move to a nearer one of the carriage home position and the maintenance ejection position. Such a configuration can shorten the time required for shifting the process to the sheet cutting operation as compared to, for example, a configuration in which the carriage is uniformly moved to the home position on performing sheet cutting.

In the inkjet recording apparatus 1 according to this exemplary embodiment, when the cutter holder 51 is placed at the maintenance ejection position, the controller 100 can perform the maintenance ejection and the sheet cutting operation simultaneously. Such a configuration can shorten the time required for the maintenance ejection and the sheet cutting operation as compared to a configuration in which the maintenance ejection and the sheet cutting operation cannot be performed at the same time, thus increasing the productivity and convenience.

In this exemplary embodiment, the cutter holder 51 has the driving roller 51*a* at the first end side in the sheet width direction and the driven roller 51*b* at the second end side in the sheet width direction. However, the configuration of the cutter holder 51 is not limited to such a configuration, and for example, the positions of the driving roller 51*a* and the driven roller 51*b* are interchangeable. In such a case, the cutter holder 51 pivots in a direction opposite the pivot direction of the above-described exemplary embodiment. Accordingly, the arrangement of the slanted face 51*c* is modified according to the pivot direction.

In this exemplary embodiment, in accordance with a position of the carriage 15 placed when the sheet cut position SCP of the rolled sheet 30 arrives at the cutter position CP of the cutter 50, the controller 100 controls the carriage 15 to move to a nearer one of the carriage home position and the maintenance ejection position. Alternatively, for example, regardless of the position of the carriage 15, the carriage 15 may be uniformly moved to the carriage home position or the maintenance ejection position.

Figure 15:
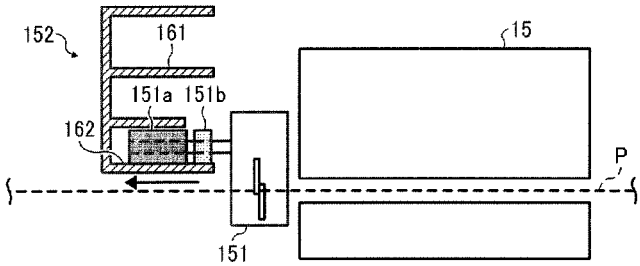
FIG. 15 is a schematic side view of a sheet cutting device according to another exemplary embodiment of this disclosure.

As described above, in this exemplary embodiment, the guide member 52 is disposed below the sheet feed path. Alternatively, as illustrated in FIG. 15, a guide member 152 may be disposed above the sheet feed path. In such a case, the forward path of a cutter holder 151 is located on a lower guide rail 162 while the backward path of the cutter holder 151 is located on an upper guide rail 161. As a result, after the cutter holder 151 moves along the forward path to cut the rolled sheet, a driven roller 151*b* moves onto the upper guide rail 161 via a moving mechanism corresponding to the moving mechanism 70 of the above-described exemplary embodiment. Thus, the cutter holder 151 is retracted from the sheet feed path so as to be movable along the backward path. After the cutter holder 151 moves along the backward path, the driven roller 151*b* moves onto the lower guide rail 162 via a communication path corresponding to a first connection path 61*c* of the above-described exemplary embodiment. Thus, the cutter holder 151 takes a position for cutting the rolled sheet. Such a configuration can obtain effects equivalent to the effects described in the above-described exemplary embodiment.

In this exemplary embodiment and the configuration illustrated in FIG. 15, the cutter holder 51 (or 151) is retracted downward or upward in the vertical direction. Alternatively, for example, in a case in which the sheet cutting device 51 is not horizontally disposed relative to the apparatus main unit 1*a*, the cutter holder 51 may be retracted in the thickness direction of the rolled sheet 30 in accordance with the inclination of the sheet cutting device 5.

In this exemplary embodiment, changing the posture of the cutter holder 51 between the forward path and the backward path allows the cutter holder 51 to move along the backward path with the cutter holder 51 retracted from the sheet feed path. Alternatively, for example, a rack-pinion type elevating device to move the guide member 52 up and down in the vertical direction device may be provided to switch the moving path of the cutter holder 51 between the forward path and the backward path.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a sheet feed device to feed a sheet along a sheet feed path;

a sheet cutting device including a cutter and a cutter holder to cut the sheet to a desired length, the cutter including opposed blades opposing each other to cut the sheet therebetween, the cutter holder holding the cutter and reciprocally movable in a width direction of the sheet perpendicular to a sheet feed direction in which the sheet is fed along the sheet feed path, and a controller to control the sheet feed device and the cutter holder, wherein the cutter holder, after cutting the sheet with the cutter, is movable in the width direction of the sheet with the cutter holder retracted away from the sheet feed path in a thickness direction of the sheet perpendicular to both the sheet feed direction and the width direction of the sheet, and the controller controls the sheet feed device to feed the sheet while the cutter holder moves in the width direction of the sheet with the cutter holder retracted away from the sheet feed path in the thickness direction of the sheet.

2. The image forming apparatus according to claim 1, wherein the sheet cutting device includes a guide member to guide the cutter holder in the width direction of the sheet, the guide member includes a first path and a second path, the second path separated from the first path in the thickness direction of the sheet, the guide member guides the cutter holder in the width direction of the sheet along the first path to cut the sheet with the cutter, and after the sheet is cut with the cutter, the guide member guides the cutter holder in the width direction of the sheet along the second path with the cutter holder retracted away from the sheet feed path in the thickness direction of the sheet.

3. The image forming apparatus according to claim 1, further comprising:

a recording head to eject ink onto the sheet fed along the sheet feed path to record an image on the sheet; and a carriage reciprocally movable in the width direction of the sheet between first and second positions, the first and second positions disposed away from each other in the width direction of the sheet outside a range corresponding to a maximum width of the sheet, movement of the carriage in the width direction of the sheet controlled by the controller, wherein, on arrival of a sheet cut position of the sheet at a cutting position of the cutter, when the carriage is placed at a position proximal to the first position, the controller controls the carriage to move to the first position, and when the carriage is placed at a position proximal to the second position, the controller controls the carriage to move to the second position and performs sheet cutting operation to move the cutter holder in the width direction of the sheet to cut the sheet with the cutter.

4. The image forming apparatus according to claim 3, wherein a maintenance ejection position at which the recording head performs maintenance ejection to eject ink droplets for maintenance and recovery of ejection performance of the recording head is disposed at a same end of the image forming apparatus as an end at which the first position of the carriage is disposed in the width direction of the sheet, and when the cutter holder is placed at the maintenance ejection position, the controller controls at least the recording head, the cutter holder, and the sheet feed device to simultaneously perform the maintenance ejection and the sheet cutting operation.

5. The image forming apparatus according to claim 3, wherein the second position is a home position of the carriage and after the recording head records the image on the sheet, the controller causes the carriage to move to the home position.

* * * * *